United States Patent [19]

Boucher

[11] 3,972,304

[45] Aug. 3, 1976

[54] DEVICE FOR FILLING MULTI-STRANDED ELECTRIC CABLE

[75] Inventor: Jean Raymond Boucher, Chateauguay Centre, Canada

[73] Assignee: Northern Electric Company Limited, Montreal, Canada

[22] Filed: Apr. 22, 1975

[21] Appl. No.: 570,396

[52] U.S. Cl. ..... 118/44; 57/2.3; 57/35; 118/DIG. 19

[51] Int. Cl.[2] ..... B05C 8/04

[58] Field of Search..... 118/4.4, DIG. 18, DIG. 19; 57/2.3, 2.5, 3.5, 35, 138; 425/112

[56] References Cited

UNITED STATES PATENTS

| | | | |
|---|---|---|---|
| 2,010,184 | 8/1935 | Fürth | 57/138 |
| 2,216,189 | 10/1940 | Ennis | 57/3.5 |
| 3,042,570 | 7/1962 | Bradt | 118/DIG. 19 |
| 3,339,357 | 9/1967 | Marzocchi et al. | 57/35 |
| 3,577,872 | 5/1971 | Drummond | 57/35 |
| 3,779,844 | 12/1973 | Dorsch | 118/44 X |

*Primary Examiner*—Louis K. Rimrodt

[57] ABSTRACT

In a device for filling the interstices of the multi-stranded core of a cable, a die freely rotatable about an axis and having a plurality of passages opening from each end of the die, the passages being arranged in a cylindrical locus about the rotational axis of the die. The device itself consists of a housing defining a chamber holding filler material through which the core passes, one end of the housing being closed by the die and the other end of the housing having an aperture axially aligned with the die.

4 Claims, 7 Drawing Figures

FIG. 1
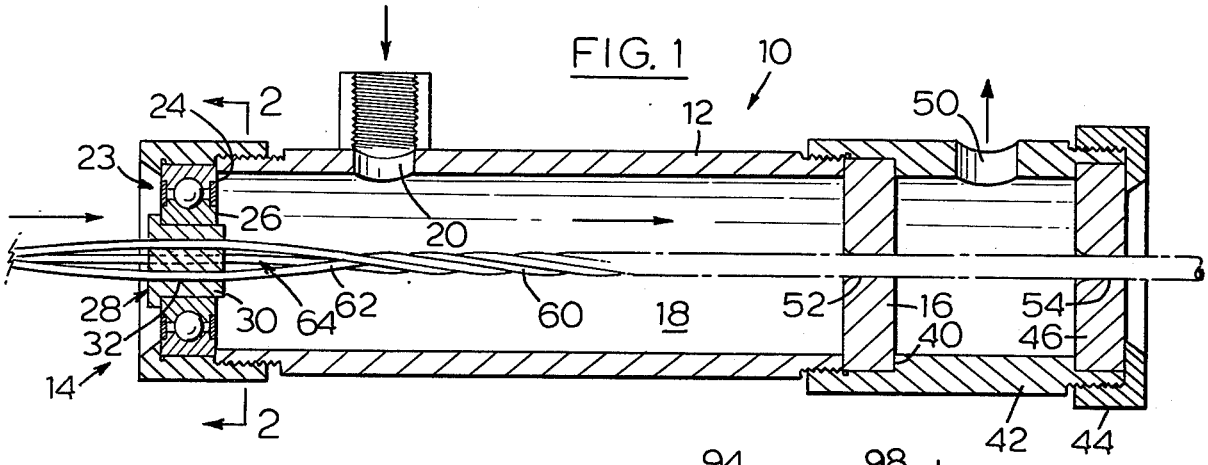
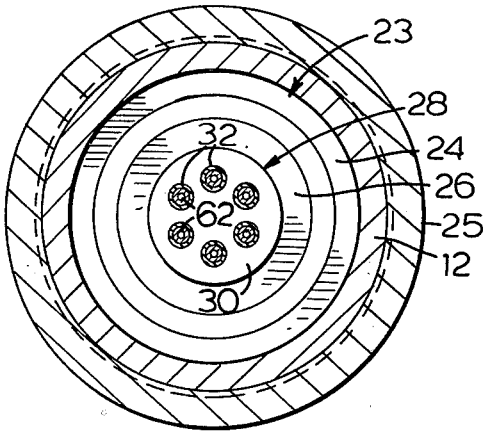
FIG. 2
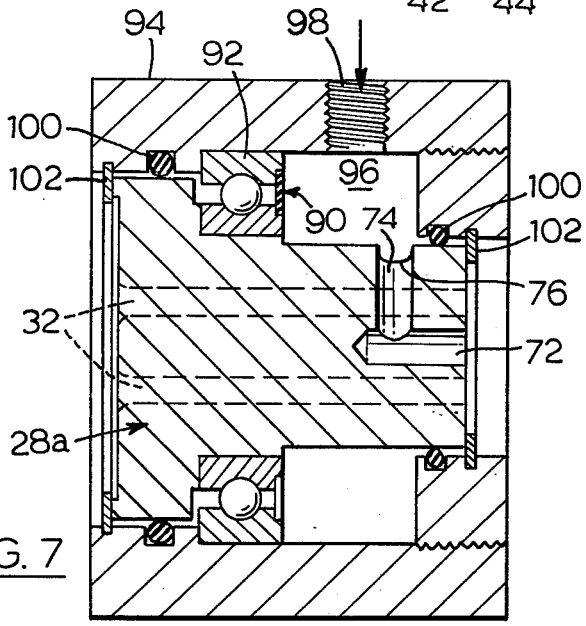
FIG. 7
FIG. 3
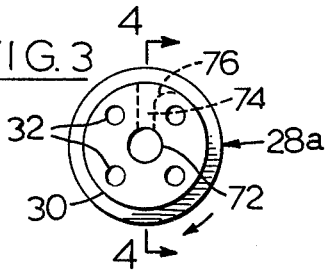
FIG. 5
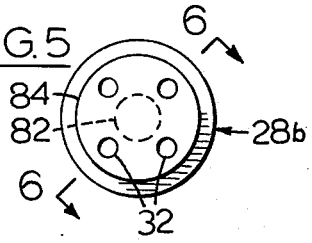
FIG. 4
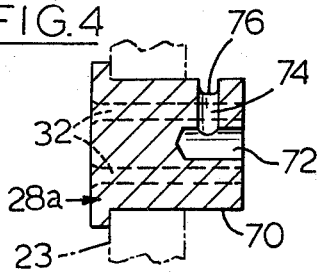
FIG. 6
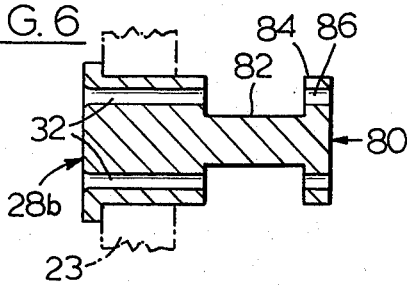

DEVICE FOR FILLING MULTI-STRANDED ELECTRIC CABLE

This invention relates to the manufacture of multi-stranded cables having a filled core.

Certain multi-stranded cables are filled, before the cable is jacketed, with viscous or solid material such as petroleum jellies or waxes, to inhibit the entry and migration of water. However, the tightness of the stranded core makes it difficult to fill the interstices or voids between the individual conductors. To overcome this problem it has been suggested to "bird-cage" the core, i.e. to spread apart the individual conductors over a length of the core sufficient to enable the interstices to be flooded with the insulating material. Where the conductors are twisted together, torque may be applied to the core in a direction opposite to the direction of the lay of the strands to spread the conductors apart, as seen in U.S. Pat. No. 2,731,069 issued Jan. 17, 1956 to H. Horn. This method is cumbersome and requires external equipment. An alternative method is to bunch the core by surface fricton but this reduces the speed of production of the cable.

It is an object of the present invention to provide an improved device for filling the multi-stranded core of a cable.

In its broadest aspect the invention consists of a die, for use in a device for filling the interstices of a multi-stranded core of an electric cable with solid or viscous material, the die being cylindrical and having a plurality of passages opening from each end thereof, the passages being arranged in a cylindrical locus about an axis, the die being journalled in mounting means and being freely rotatable about said axis, each of said passages being of a diameter to pass at least one strand of said core whereby the strands are spread apart on passing through the die, one end portion of the die projecting axially from the mounting means, said one end portion carrying passage means opening from the side thereof to define scoop means and opening axially from the free end thereof.

Example embodiments of the invention are shown in the accompanying drawings in which:

FIG. 1 is a cross-sectional side view of a corefilling device;

FIG. 2 is a cross-sectional view taken along line 2—2 of FIG. 1;

FIG. 3 is an end view of an alternate embodiment of the rotating die of the device of FIG. 1;

FIG. 4 is a cross-sectional view taken along line 4—4 of FIG. 3;

FIG. 5 is a cross-sectional view of another alternate embodiment of the rotating die of the device of FIG. 1;

FIG. 6 is a cross-sectional view taken along line 6—6 of FIG. 5; and

FIG. 7 is a cross-sectional view of a further alternate embodiment of the rotating die of FIG. 1.

The example embodiment shown in FIGS. 1 and 2 of the drawings consist of a core-filling device 10 comprising a tubular member 12 having one end closed by a die mount 14 and the other end closed by a cap 16, to form a chamber 18. A lateral port 20 opens into chamber 18 from an internally threaded boss 22 fixed on the outer surface of member 12.

Die mount 14 consists of an annular sealed bearing 23 having an outer race 24 fixed to member 12 by a flanged and threaded collar 25 and an inner race 26 carrying an axially disposed cylindrical die 28. Die 28 consists of a cylindrical body member 30 having a plurality of passages 32 substantially parallel to the axis of the die and equally spaced circumferentially about the axis of the die, the number of passages corresponding to the number of conductors in the core to be spaced apart.

Cap 16 at the other end of tubular member 12 is held in position by the shoulder 40 of an annular member 42 threaded into the end of tubular member 12. Annular member 42 is closed at its free end by a threaded collar 44 holding a further end cap 46 to form an auxiliary chamber 48 having an outlet port 50. End caps 16 and 46 have apertures 52 and 54 respectively in axial alignment with die 28.

In the operation of the example embodiment shown in FIGS. 1 and 2 the starting end of a multi-stranded core 60, having four individual conductors 62 twisted together to form a lay, is threaded through passages 32 of die 28. The starting end of core 60 is then passed through aperture 52 of end cap 16 and aperture 54 of end cap 46, traversing chambers 18 and 48 respectively. Filler material is then pumped into chamber 18 to fill the chamber under pressure. To fill core 60 the core is passed continuously through chamber 18 in the direction of end cap 16. As any portion of core 60 enters die 28, conductors 62 are spread apart as they traverse passages 32 and as the conductors leave die 28 they are maintained apart to define a space 64 into which flows the filler material occupying chamber 18 under pressure. At a point spaced from their exit from die 28, conductors 62 close together again, and by the material twisting process already present in core 60 the filler continues to occupy the interstices between them. As conductors 62 of core 60 traverse passages 32, die 28 rotates to accomodate the lay of the conductors in the core. The direction of rotation of die 28 is opposite the direction of lay of core 60 looking in the direction of advancement of the core.

As core 60 passes out of chamber 18 through aperture 52, end cap acts as a wiper to remove excess filler material from the core. End cap 46 acts as a second wiper to remove remaining excess filler material, which accumulates in auxiliary chamber 48 and passes out through port 50. It will be appreciated that auxiliary chamber 48 and end cap 46 are not essential to the invention.

In the embodiment shown in FIGS. 3 and 4 of the drawings a cylindrical die **28*a* has an end portion 70 which projects into chamber 18. End portion 70 has an axial bore 72 intersecting a radial bore 70 which in turn intersects a lateral opening 76 leading into chamber 18 at the perimeter of end portion 70 to form a scoop. In use, lateral opening 76 is located to act as a scoop when die 28*a* is rotated by the lay of core 60 as seen in FIG. 4. In this way filler material is taken into lateral opening 76 and passes into radial bore 74 and then into axial bore 72. Under pressure from filler material entering lateral opening 76 the filler emerges from axial bore 72 into space 64 which is defined by conductors 62 passing from die 28*a*. This ensures that filler material is not excluded from space 64 because of the effect of rotation of conductors 62** about the space.

The embodiment shown in FIGS. 5 and 6 of the drawings again comprises a die which will assist the filler material in occupying the voids between conductors 62. In this embodiment a cylindrical die **28*b* has an end portion 80 which projects into chamber 18. An annular recess 82 is located in end portion 80, spaced from the free end of the die to define a flange 84 which has apertures 86 co-axial with passages 32. Thus recess 82 undercuts passages 32. As conductors 62 pass through die 28 they traverse recess 82 which allows filler material to contact the entire surface of each conductor, thus increasing the immersion time for each conductor before the conductors merge again in chamber 18**.

The embodiment shown in FIG. 7 of the drawings is an alternate construction of device of FIG. 1 utilizing the die of FIGS. 3 and 4 to have the pressure chamber as an integral part of the die mount. In this embodiment cylindrical die 28*a* is rotatably held by an annular sealed bearing 90 having an outer race 92 fixed to a die mount 94. An annular recess on the inner side of die mount 94 defines, with die 28*a*, a pressure chamber 96. An inlet 98 opens into chamber 96 while opening 76, radial bore 74, and axial bore 72 provide an outlet from the chamber. O-rings 100 seal pressure chamber 96 and retaining rings 102 assist in holding die 28*a* in place. Die mount 94 of this embodiment may be fixed to a tubular auxiliary tank in the manner shown in FIG. 1.

It will be appreciated that die 28 may have any number of passages 32 depending on the number of strands in core 60 to be accommodated.

For cores with short lays, or to increase the coating speed, the rotation of die 28 may be assisted by motor means. In such a case outer race 24 of bearing 23 would be turned in the same direction as die 28 but at a slightly slower speed to allow die 28 to make up the difference in speed to accommodate the lay of core 60.

I claim:

1. A device for filling the interstices of a multistranded core of a cable with solid or viscous material, comprising a cylindrical die having a plurality of passages opening from each end thereof, the passages being arranged in a cylindrical locus about an axis, the die being journalled in mounting means and being freely rotatable about said axis, each of said passages being of a diameter to pass at least one strand of said core whereby the strands are spread apart on passing through the die, one end portion of the die projecting axially from the mounting means, said one end portion carrying passage means opening from the side thereof to define scoop means and opening axially from the free end thereof.

2. A device as claimed in claim 1 including a housing defining a closed chamber with a port opening into the chamber for the introduction of material under pressure, the die being mounted in one wall of the housing, and an aperture in another wall of the housing opposite the die to pass the core from the chamber.

3. A device as claimed in claim 2 in which the housing comprises a cylinder, one end of the cylinder being closed by a die mount having the die journally mounted therein, the other end of the cylinder being closed by an end cap having said aperture therein co-axial with said axis.

4. A device for filling the interstices of a multistranded core of a cable with solid or viscous material, comprising:

a cylindrical die having a plurality of passages opening into the chamber each to pass at least one strand of said core, the passages being arranged in a cylindrical locus about an axis;

a die mount carrying the die, the die being freely rotatable about said axis, the die mount having an inwardly directed annular recess forming with the die a closed chamber, a port opening through the die mount into the chamber for the introduction of material under pressure;

the die having passage means opening from the side thereof into the chamber to define scoop means and opening axially from one end of the die.

* * * * *